United States Patent [19]

Queen

[11] 4,248,266

[45] Feb. 3, 1981

[54] LIQUID SOAP INJECTOR FOR A WATER BATH SPRAY SYSTEM

[76] Inventor: Carl J. Queen, 1041 Bunin La., Riviera Beach, Fla. 33404

[21] Appl. No.: 958,658

[22] Filed: Nov. 8, 1978

[51] Int. Cl.[3] ..... F16K 19/00

[52] U.S. Cl. ..... 137/564.5; 137/605; 137/606; 137/897

[58] Field of Search ..... 137/564.5, 604, 605, 137/625.4, 606; 251/325

[56] References Cited

U.S. PATENT DOCUMENTS

| | | | |
|---|---|---|---|
| 2,599,678 | 6/1952 | Walker | 137/604 X |
| 2,969,923 | 1/1961 | Fremion | 251/325 X |

FOREIGN PATENT DOCUMENTS

| | | | |
|---|---|---|---|
| 619355 | 4/1961 | Italy | 137/625.4 |

*Primary Examiner*—Robert G. Nilson

[57] ABSTRACT

A liquid injector system for introducing, metering, and premixing a liquid hygienic agent such as soap or medicant into a stream of water flowing through a conduit for dispensing in a bath or shower array of spray nozzles. The system includes at least one manually operated piston valve mounted in the water flow line to the spring nozzles and include communication with an agent injector cylinder having a dispensing system actuated by system water pressure. The valve includes a housing with a water flow-through, direction reversal chamber in fluid communication with the reciprocally movable valve body having an axial passage terminating in a radial passage near a mid-portion of the valve body. The system ensures for positive metering and thoroughly mixing the agent in the spray system.

5 Claims, 11 Drawing Figures

LIQUID SOAP INJECTOR FOR A WATER BATH SPRAY SYSTEM

BACKGROUND OF THE INVENTION

This invention relates generally to a device that allows for injecting a first liquid into the flowing stream of a second liquid to insure metering, thorough mixing, and positive, relatively instantaneous blending of the two liquids. In the specific embodiment disclosed herein, the system provides for the injection of a liquid hygenic agent into a stream of water as it flows through a conduit for use in a sit down bath system which has a plurality of spray nozzles disposed therein.

One of the problems in the past in injecting one type of liquid into another has been the failure to properly blend the first liquid into the second liquid so that the first liquid does not merely travel as a unitary mass in the second liquid stream. For example, when dispensing water from a shower or spray system, it is desirable to inject small quantities of a liquid agent into the stream of water such that the person experiencing the shower may receive a sufficient amount of uniformly blended hygenic agent for lathering and proper hygiene. This is especially critical in hospitals and other types of institutions where hygiene is paramount and it is desirous to not use cakes or bars of soap, which can transmit disease. One of the problems in dispensing liquid soap or agent into a stream of water which is ultimately sprayed is that if the soap is not properly blended and mixed with the water stream, much greater quantities of soap will be needed for the recipient to have sufficient lathering. This results in no uniform distribution of lather to the nozzle system. Another problem is that oftentimes a composition of materials such as soap or medicant can be harmful to valves and orifices and can congeal or clog the valve lines causing the system to be inoperative. And yet, another problem in injecting soap or agent into a liquid line is that the operator may oftentimes inject excessive amounts of soap if the system does not respond rapidly to the manual actuation of the dispensing valve.

The present invention overcomes the problems in the prior art by providing an agent injector that thoroughly mixes the liquid agent during the injection into the flowing stream of water, provides for cleansing of the valve area when the system is not in use, while providing a rapid injection into the system for fast response.

BRIEF DESCRIPTION OF THE INVENTION

A system for injecting a first liquid into a flowing stream of a second liquid comprising an injector for said first liquid, a valve for manually injecting said first liquid into said second liquid, said valve including a housing having an inlet and outlet connected into the conduit bearing the second liquid stream, said first liquid injector including a piston in which one side is connected to the second liquid pressure.

In the embodiment disclosed herein, the first liquid utilized is a liquid hygenic agent which is injected into the second fluid which is water and dispensed in a sit down bath having a plurality of spraying nozzles disposed therein.

The injector cylinder which contains the liquid hygenic agent is a cylindrical container having a floating piston disposed therein and a conical spring with its larger spring base end being disposed into the top end of the container with a smaller end disposed into the top of the piston which is movable along the longitudinal axis of the container. The piston includes two cup seals mounted back to back for sealing in opposite directions. On the opposite side of the piston, water pressure from the system is allowed to enter such that the pressure forces the piston against the liquid agent and the spring so that when the outlet line from the agent cylinder is opened, which is discussed below, the piston will force the agent into the valve housing. The tapered conical spring allows the piston to return to the bottom of the cylinder when the water pressure is removed for filling the container. With the smaller end of the spring in the piston, the piston keeps its alignment during downward movement to prevent jamming of the piston in the cylinder chamber. The injector also includes a passage for replenishing the liquid agent when necessary and a valve for relieving system water pressure when it is desirous of purging water for filling the container. With the system water pressure removed, the spring will force the piston to the bottom of the container.

The agent injector valve, which is the heart of the system, includes a block-shaped valve housing which has at least one chamber which includes inlet and outlet openings coupled to the mainstream water supply. Whenever the water system is turned on to the nozzle sprays, water passes through the flow-through, reversal chamber in the valve block housing regardless of whether liquid agent is being injected or not. The axes of the inlet and outlet openings for the water supply are substantially parallel and are both formed in the same face of the valve housing such that the stream of water experiences approximately a 180 degree reversal of direction in the flow-through reversal chamber at the base of the valve body. The valve block housing also includes at least one cylindrical chamber which receives the valve body itself, which is movable axially in a longitudinal direction within the cylindrical chamber. The cylindrical chamber opens at one end into the flow-through, reversal chamber.

The valve body is substantially a cylindrical piston having a land portion disposed between two seals, the land diameter being smaller than the cylindrical chamber diameter forming a sealed chamber between the land surface, the seals and the cylindrical chamber surface. The land between the two seals has a radial passage and metering orifice that opens into the sealed land chamber, the other end of the radial passage communicating with an axial passage disposed within the valve body which opens into (at the base of the valve body) the flow-through, reversal chamber in the valve housing. A spring is connected and disposed partially within the flow-through, reversal chamber to the base of the valve body which acts to hold the valve body in the closed position. The spring also acts in conjunction with the water flow reversed to generate eddy currents and turbulence by providing a fluid resistance in the flow-through, reversal chamber water path to create additional turbulence in the water flowing therethrough. An inlet passage from the agent injector is disposed through the valve housing to a specific longitudinal location along the cylindrical chamber surface that receives the valve body. In the non-injecting position, the inlet opening from the agent injector is disposed such that it is not aligned with the metering orifice, but with a bypass chamber formed by the valve body. When the valve body is manually positioned such that the metering orifice is positioned in fluid communication with the agent inlet opening, the sealed land chamber then receives liquid agent under pressure which is forced into the radial passage in the valve body, down through the axial passage in the valve body, into the flow-through, reversal chamber. Since water is retained in the metering orifice and sealed land chamber between the seals when the valve is not actuated, immediately upon actuation of the valve, liquid agent begins premixing with water in the land chamber as it is forced into the reversal chamber in the valve housing. Additional mixing is achieved in the reversal chamber due to the turbulent reversal of direction of the water as it passes through the reversal chamber. When the valve returns to its non-injecting position, residual liquid agent is purged from the axial and radial passages and the metering orifice by water flowing through the system. Further, as the main flow of water continues without agent injection, water will be forced back into the axial and radial passages into the sealed land chamber thus insuring that they will be free of residual agent to prevent clogging or congealing in the passages and chambers. Water and agent act as a lubricant on the walls of the valve body chamber so that the valve body is freely movable between the non-injecting and injecting positions.

The valve body also includes a bypass chamber that allows the agent to flow around the valve body in the non-injecting position for availability of the agent to adjacent valves, for use in a multiple valve system.

To operate the device, the mainstream of water is turned on. This could be used with a shampoo or bath spray system which sprays water at a preset temperature through a single conduit. When it is desirous to receive liquid agent, the valve is depressed manually, causing the agent to be injected into the stream of water and thoroughly mixed and sprayed out the particular nozzle in a shower-like action. When the valve is released, the injection of agent ceases.

It is an object of this invention to provide a system which allows for injection of a first liquid into a flowing stream of a second liquid to insure a thorough mixing of the first and second liquids.

It is another object of this invention to provide an injector which allows soap, medicant or other type of liquid to be injected into a flowing stream and which prevents residual corrosion or clogging of the injector lines.

And yet still another object of this invention is to provide a positive fluid injector which is reliable in operation and which provides for instantaneous mixing of the first liquid into a stream of a second liquid for uniform dispensing.

Still yet another object of this invention is to provide an injector system for metering and mixing two liquids together in a homogeneous mixture suitable for dispensing through a plurality of spray outlets.

In accordance with these and other objects which will be apparent hereinafter, the instant invention will now be described with particular reference to the accompanying drawings.

PREFERRED EMBODIMENT OF THE INVENTION

Figure 1:
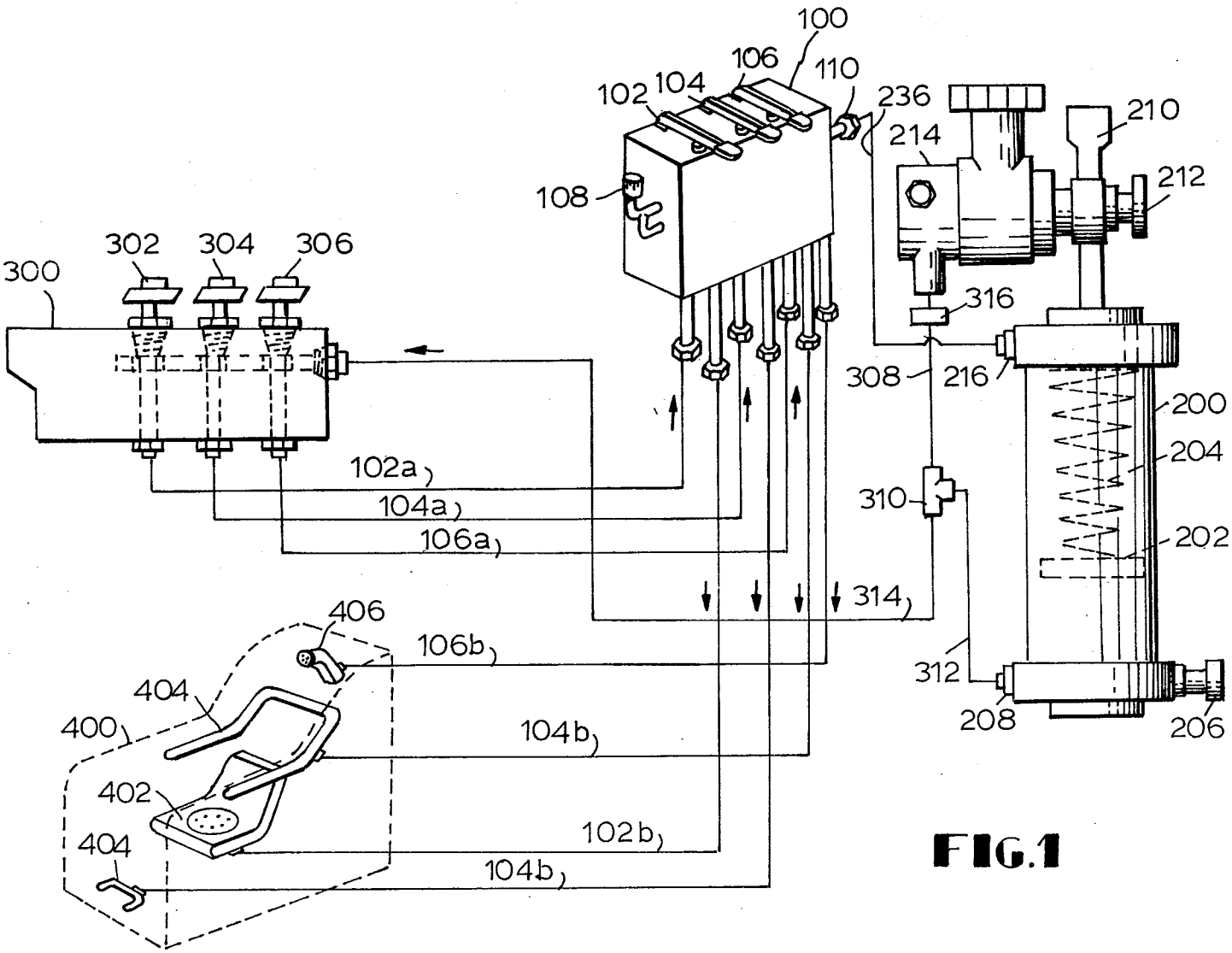
FIG. 1 shows a schematic diagram of one embodiment of the present invention.

Referring now to the drawings and specifically FIG. 1, one embodiment of the present invention is shown comprised of three liquid agent injector valves 102, 104, and 106 in valve housing 100 which is connected to a liquid agent injector 200 which houses liquid agent for injection and use with a shampoo spray 406, shower spray 404, foot spray 404, and a sitz bath spray 402. The inlet water to the various sprays is controlled by faucet type valves 302, 304, and 306 connected to a faucet valve housing 300. The primary inlet water comes through line 308 from thermostat control 214 into a T-shaped fitting 310 which is connected to inlet water line 312 coupled to the agent container 200 (which is discussed in greater detail below). The other inlet water line 314 is connected directly into the faucet valve block 300. Valve 302 supplies primary water into and out of the valve block housing to the sitz bath spray 402. Valve 304 supplies inlet and outlet water to valve block housing 100 for both the shower spray 404 and the foot spray 404. Valve 306 supplies primary water into and out of the valve block housing 100 for the shampoo spray 406. Liquid agent may be injected into the sitz bath spray by actuation of handle 102 on valve block 100. Agent is injected by actuation of handle 104 into the shower spray 404 and the foot spray 404, while agent injection is achieved with handle 106 into shampoo spray 406. In the present system, the sitz bath spray 402, the shower and foot spray 404 and the shampoo spray 406 may be independently operated or may be operated together, depending on the position of valves 302, 304, and 306. Note that when any of the spray systems are operating, whether independently or together, primary inlet water flow passes through the agent injector valve housing 100, whether or not soap is being injected.

Figure 2:
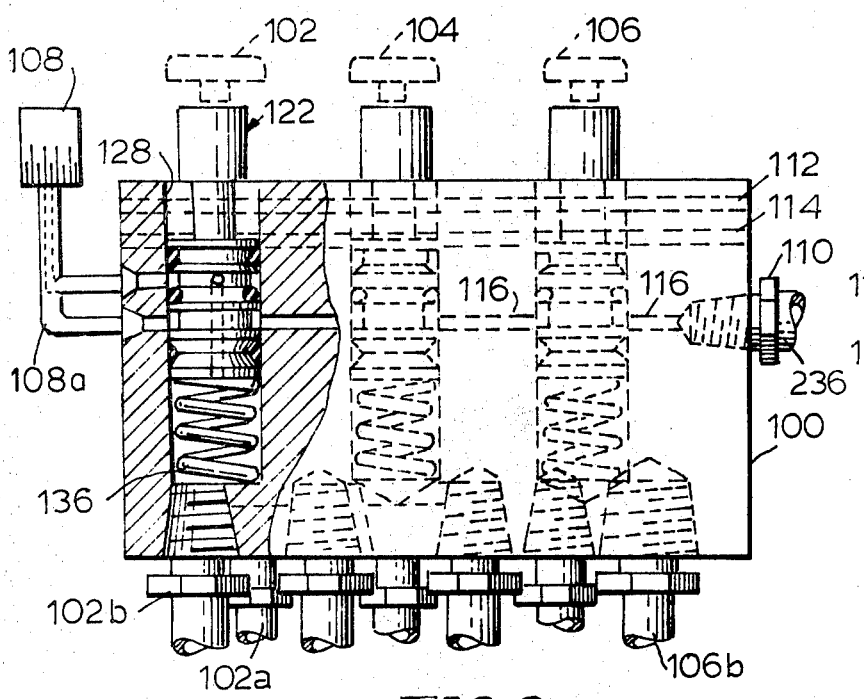
FIG. 2 shows a front elevational view partially in cross-section of the valve housing and valve body utilized in one embodiment of the present invention.
Figure 3:
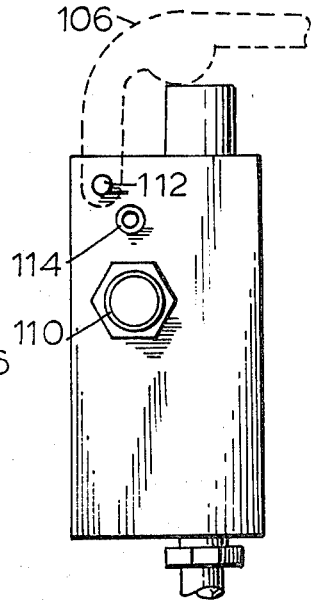
FIG. 3 shows a side elevational view of the valve shown in FIG. 2.

Referring now to FIG. 2, the liquid agent injector valve is shown which includes a rigid housing 100 that has a fitting 110 which is connected to the agent injector and an interior passage 116 which opens into a plurality of vertically aligned chambers, such as chamber 128. Since each valve 102, 104, and 106 operates identically, only one valve 102 will be discussed in detail. Inlet water is received into the valve block 100 through tube **102*a* into passage 128 which is in fluid communication with outlet line 102*b* which, for this example, is connected to the sitz bath spray 402, shown in FIG. 1. The valve body 122 engages actuating handle 102 which is described in greater detail below. Each of the handles 102, 104, and 106 are pivotally connected to a rod 112, which is disposed through the housing 100. A spring 136 holds the valve body 122 in a first position against rod 114 when the soap injection is not in operation. A variable metering valve is also used for mixing and injecting a specific quantity of medicant through valve body 122**.

Figure 5:
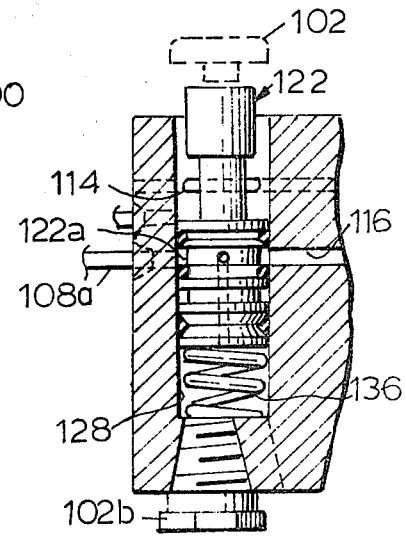
FIG. 5 shows a fragmentary cross-sectional view of a portion of the valve block and a single valve body utilized in the present invention.
Figure 6:
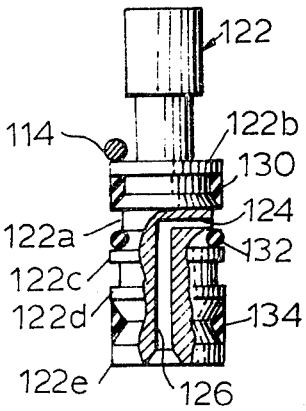
FIG. 6 shows a valve body partially in cross-section in a side elevational view as utilized in the present invention.

Referring now also to FIGS. 5 and 6, the valve body 122 is shown which includes a land **122*a* having a radial passage and metering orifice 124 and an axial passage 126 disposed therethrough. Disposed on each side of the orifice 124 are seals such as the "O"-ring seal 132 and the cup seal 130. The seals 130 and 132 in conjunction with the land 122*a* and cylinder wall 128 form a pre-mixing chamber. FIG. 2 shows the valve body 122 in the non-injecting position, while FIG. 5 shows the valve body 122 positioned for injecting the liquid agent. Rod 114 which protrudes into chamber 128 acts as a stop to limit the upper movement of the valve body in the non-injecting position. Inlet 102*a* provides inlet water into the lower portion of the cylindrical chamber 128 housing the valve body 122. Outlet water passes through outlet 102*b* to sitz bath spray 402. The lower portion of the cylindrical chamber 128 acts as a flow-through, water reversal chamber which is in fluid communication with the lower opening of the axial passage 126 in the valve body 122. The spring 136 acts to enhance the turbulence as the water direction changes in the lower portion of chamber 128. As shown in FIG. 5 with the valve body 122 depressed, agent under pressure is received through passage 116 into the chamber formed by land 122*a*, into the metering orifice passage 124 of the valve body where it is forced through the axial passage 126 into the lower portion of chamber 128 where it is thoroughly mixed with the water flowing therethrough. The water and agent mixture then pass through outlet 102*b* to the sitz bath spray 402**.

Figure 4:
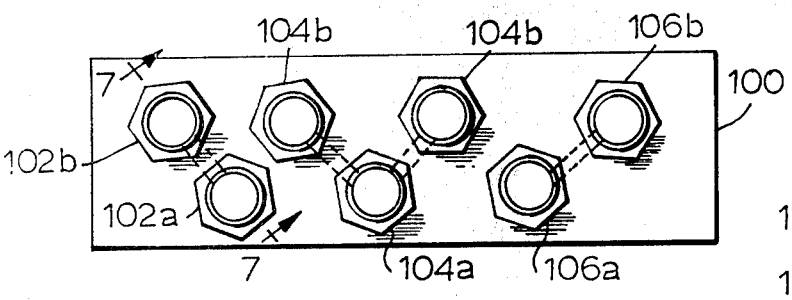
FIG. 4 shows a bottom plan view of the valve housing shown in FIG. 2.

FIG. 4 shows the multi-valve block housing 100 with water inlets **102*a*, 104*a*, and 106*a*. Inlet 102*a* in conjunction with water outlet 102*b* is connected to the sitz bath spray. Two common outlets 104*b* are connected to the shower spray and foot spray and receive water from inlet 104*a*. Outlet 106*b* is connected to the shampoo spray. Thus in the present embodiment, soap or other liquid agent may be injected independently into a particular spray or by depressing all three valves may be simultaneously injected into all of the spray systems. Note in FIG. 6 that a by-pass chamber is joined between lands 122*c* and 122*d* that allows the liquid agent received in passage 116** to flow past a valve not being used to flow to the adjacent valves.

Figure 7:
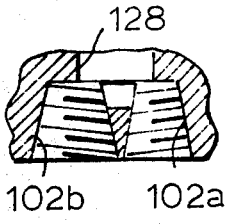
FIG. 7 shows a cross-sectional view of the portion of the flow-through, reversal chamber through line 7—7 of FIG. 6 utilized in the instant invention.

FIG. 7 shows the flow-through, reversal chamber which includes the inlet passage **102*a* in fluid communication with chamber 128 and outlet passage 102*b***.

Figure 8:
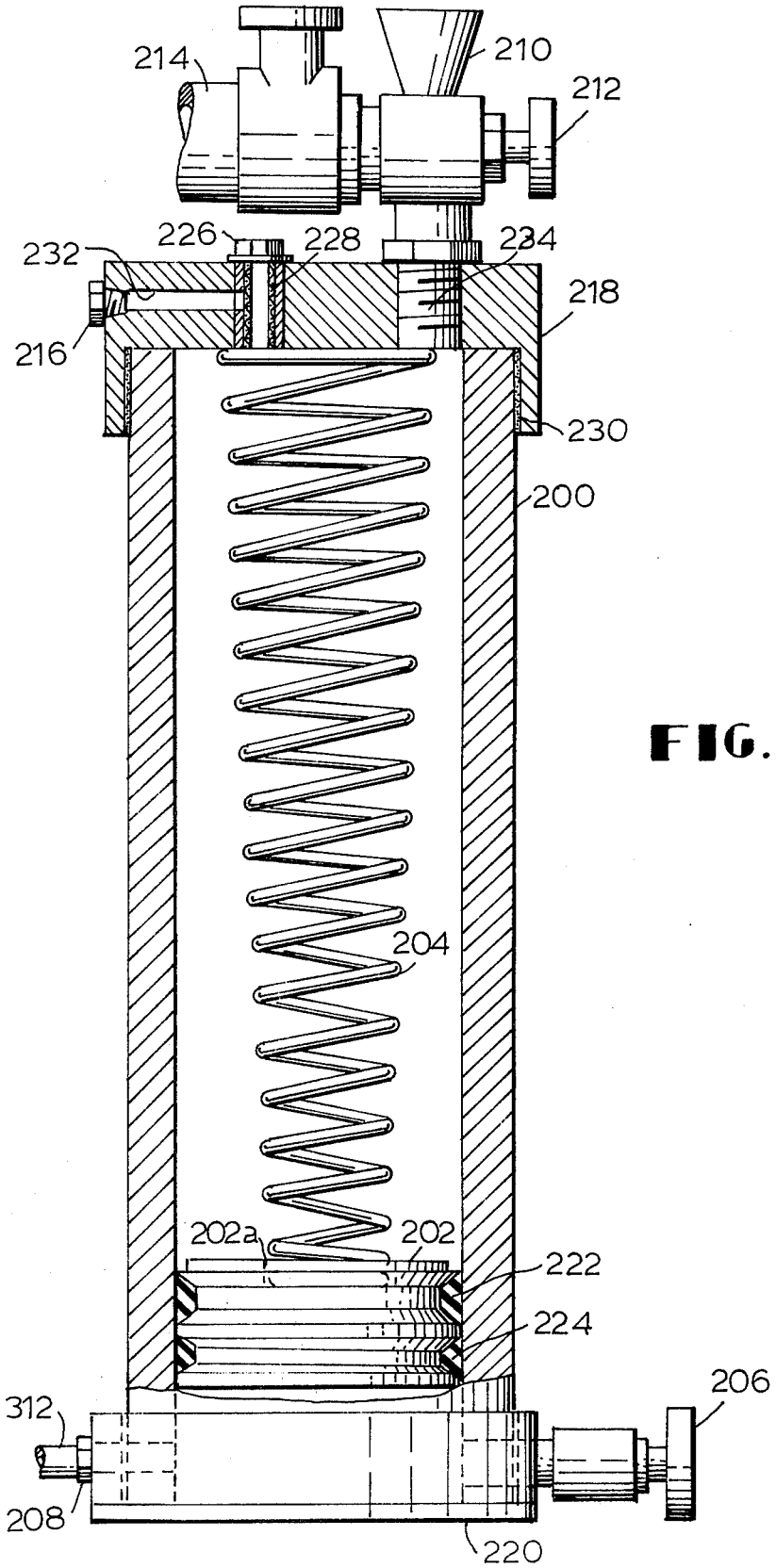
FIG. 8 shows a side elevational view partially in cross-section of the liquid agent container utilized in the instant invention.
Figure 9:
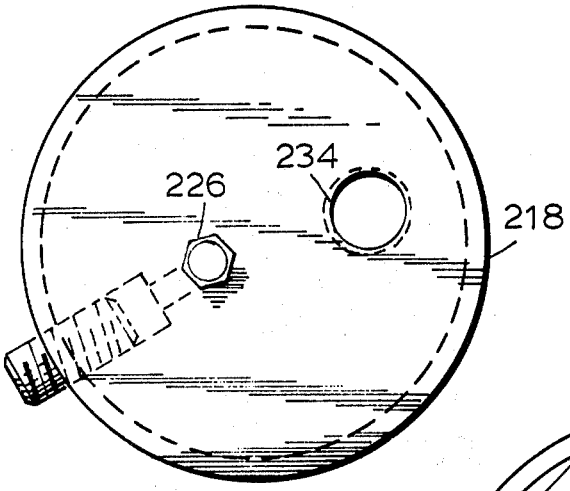
FIG. 9 shows a top plan view of the liquid agent container shown in FIG. 8.
Figure 10:
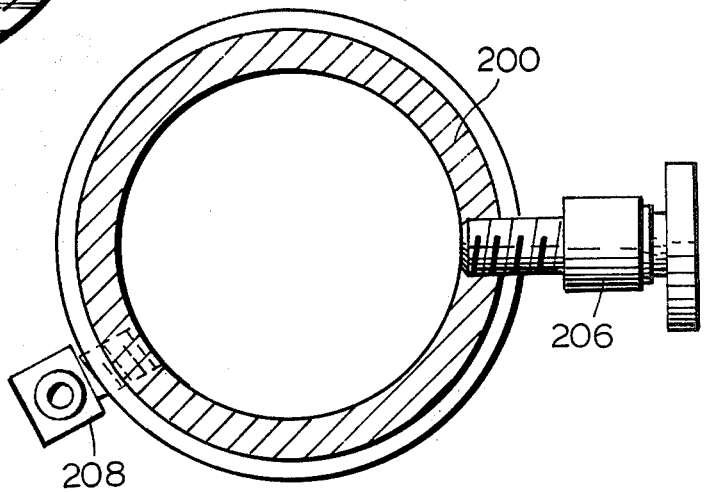
FIG. 10 shows a bottom plan view partially in cross-section of the liquid agent container shown in FIG. 8.

Referring now to FIG. 8, the liquid agent container is shown comprised of a cylindrical hollow body 200 having a movable piston 202 disposed therein coupled to a conical spring 204 which has its larger end diameter at the upper end of the container and the smaller diameter disposed in a groove **202*a* in piston 202. The container 200 includes a cap 218 which is affixed by adhesive 230 to the top of body 200. A filler opening 210 and filler valve 212 is connected through cap 218 through inlet 234 which allows the container to be filled with a liquid agent. An inlet water line 312 is connected at the base of the container by fitting 208 which receives water at system pressure on the bottom side of piston 202. A relief valve 206 allows the water pressure to be dumped during agent filling. A removable filter screen 228 is provided to filter the liquid agent as it passes out of the container through passage 232, fitting 216 and line 236 into the valve housing 100. System water pressure on the bottom side of piston 202 pushes against spring 204 and the liquid agent contained in the chamber above the piston to provide positive pressure on the liquid agent. The conical spring 204 is used to return the piston 202 to the bottom of the container for filling when the water pressure on the bottom of the piston is relieved through valve 206. It has been found that using the smaller end of the spring on the piston acts to provide a more uniform force on the piston during return, preventing jamming. The piston 202 has a pair of cup seals 222 and 224 mounted back to back which allows free movement of the piston while sealing the liquid agent from the system water. Plug 226 allows for the screen 228 to be removed for cleaning. FIGS. 9 and 10 show the cap 218 and relief valve 206** respectively.

Figure 11:
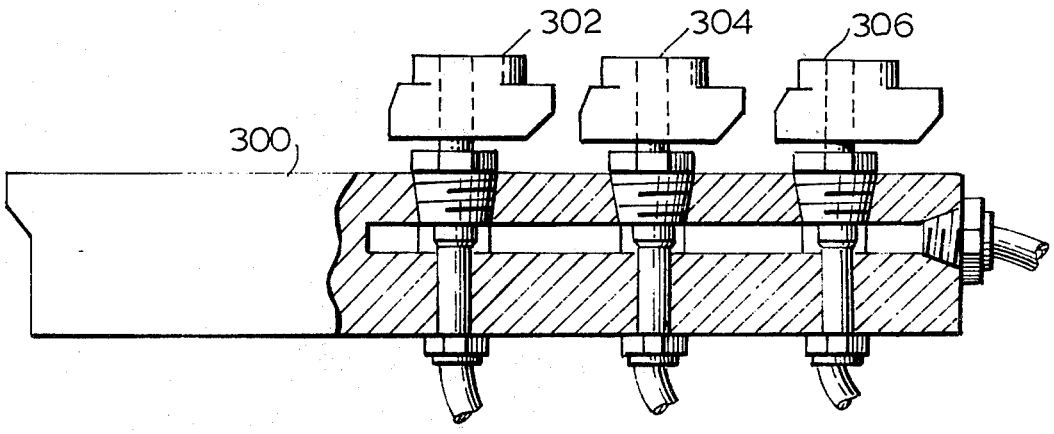
FIG. 11 shows the main system water valves utilized in the present invention.

FIG. 11 shows the primary water valve 302, 304, and 306 which are conventional in operation and do not form a part of the present invention.

Referring back to FIGS. 2 through 7, when the injector is not in operation, FIG. 2 shows the valve position such that liquid agent under pressure in passage 116 in the valve housing 100 is permitted to pass by each valve between lands **122*c* and 122*d*. In this position also, water is received through inlet fitting 102*a* into the flow-through, reversal chamber 128 and out through outlet 102*b*. When the valve body 122 is moved along its longitudinal axis by depressing handle 102, the land 122*a* having the radial passage and metering orifice 124 (FIG. 5) is positioned such that the inlet liquid agent passage 116 is aligned between seals 130 and 132 forcing the liquid agent (under pressure from the injector) through the radial passage 124 and axial passage 126 into the pass-through flow reversal chamber at the lower end of chamber 128. Prior to injection actuation, water under pressure is in the chamber formed between the seals 130 and 132. This water also acts as a lubricant on the wall of cylinder 128. Thus, as soon as the valve is actuated, liquid agent begins pre-mixing with the water already present around land 122*a*. Primary mixing is achieved in the flow-through, reversal chamber as the water changes direction at the base of valve body 122** which creates a turbulence, enhancing and increasing the mixing action of the agent with the water.

As shown in FIG. 2, each of the injector valves, 102, 104, and 106, may be independently actuated to provide liquid agent to either the shampoo spray 406, the shower sprays 404, or the sitz bath spray 402 independently.

Fixed metering of the liquid agent in each of the valves 102, 104, and 106 is accomplished by selection of a particular size diameter of the metering orifice and radial passage 124. However, in some situations, i.e. using a medicant as the liquid agent, variable, extremely precise volumetric metering is necessary. A calibrated metering valve 108 (FIG. 2) may be employed, bypassing the valves 102, 104, and 106. In this case, medicant is forced under pressure through passage 116 around the valve bodies into the calibrated metering valve 108. Outlet line **108*a* from valve block 100 permits discharge of a specific quantity of medicant by a metering valve 108 into the pre-mixing chamber between seals 130** and 132, forcing the medicant into radial passage 124, axial passage 126, and the flowthrough, reversal chamber. This injection occurs without depressing valve 102, by opening calibrated valve 108. The metering valve shown 108 is a valve that extends down between the two conduits, the lower conduit being 108*a*. The metering gauge of valve 108 element has a shaft that meters and extends between the two conduits as shown. The valve body that accomplishes this is shown dotted.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A system for injecting a first liquid into a second liquid stream such that the first liquid and second liquid are mixed thoroughly together in metered quantities, comprising:

a valve housing, said housing having at least one chamber for receiving a valve body, said housing including an inlet passage for receiving said first liquid, said housing further including an inlet and outlet passage for receiving said second liquid, said second liquid inlet and outlet passages being in fluid communication with said valve body chamber;

a valve body disposed moveably within said valve body housing chamber, said valve body including a land area disposed around its perimeter, the diameter of the land being less than the diameter of said valve body chamber;

first and second sealing means each disposed on an opposite side of said valve body land;

said valve body including an interior passage providing fluid communication between the surface of said land and the base of said valve body;

means connected to the bottom of said valve body chamber and contacting the bottom of said valve body for resiliently holding said valve body in a first position;

said second liquid inlet and outlet means having substantially parallel longitudinal axes, said valve body being moveable to a second position whereby said land area on said valve body is in fluid communication with the first liquid inlet passage in said housing.

2. An injector system as in claim 1, including:

a means connected to said valve housing for stopping said valve body in a predetermined position.

3. An injector system as in claim 1, including:

a receptacle for housing said first liquid;

a floating piston disposed within first liquid receptacle;

inlet means connected to said receptacle on one side of said piston for receiving said second liquid under pressure;

outlet means disposed on the opposite side of said piston connected to the first liquid inlet passage in said valve housing.

4. An injector system as in claim 3, including:

means connected to said valve housing and said valve body for moving said valve body from a first position to a second position.

5. An injector system as in claim 4, wherein:

said valve body resilient positioning means includes a means for providing fluid resistance disposed in fluid communication with said second liquid inlet and outlet means.

* * * * *